US010820774B2

(12) United States Patent
Lindenbeck

(10) Patent No.: US 10,820,774 B2
(45) Date of Patent: Nov. 3, 2020

(54) WET-CLEANING APPLIANCE HAVING A CLEANING ROLLER

(71) Applicant: Vorwerk & Co. Interholding GmbH, Wuppertal (DE)

(72) Inventor: Bernd Lindenbeck, Leverkusen (DE)

(73) Assignee: Vorwerk & Co. Interholding GmbH, Wuppertal (DE)

( * ) Notice: Subject to any disclaimer, the term of this patent is extended or adjusted under 35 U.S.C. 154(b) by 70 days.

(21) Appl. No.: 16/313,497

(22) PCT Filed: Jun. 13, 2017

(86) PCT No.: PCT/EP2017/064359
§ 371 (c)(1),
(2) Date: Dec. 27, 2018

(87) PCT Pub. No.: WO2018/001716
PCT Pub. Date: Jan. 4, 2018

(65) Prior Publication Data

US 2019/0313876 A1 Oct. 17, 2019

(30) Foreign Application Priority Data

Jun. 28, 2016 (DE) ..... 10 2016 111 811

(51) Int. Cl.
*A47L 13/42* (2006.01)
*A47L 13/22* (2006.01)

(52) U.S. Cl.
CPC ..... *A47L 13/42* (2013.01); *A47L 13/22* (2013.01)

(58) Field of Classification Search
CPC .... A47L 13/42; A47L 11/292; A47L 11/4088; A47L 11/4044; A47L 11/4083;
(Continued)

(56) References Cited

U.S. PATENT DOCUMENTS 1,536,687 A 5/1925 Oatey
1,783,205 A * 12/1930 White ..... A47L 9/04 15/392

(Continued)

FOREIGN PATENT DOCUMENTS

DE 102 29 611 B3 1/2004
DE 20 2009 013 434 U1 12/2009

(Continued)

OTHER PUBLICATIONS

International Search Report of PCT/EP2017/064359, dated Sep. 5, 2017.

(Continued)

*Primary Examiner* — Robert J Scruggs
(74) *Attorney, Agent, or Firm* — Collard & Roe, P.C.

(57) ABSTRACT

A wet-cleaning appliance, in particular a wet mop, has a cleaning roller, which is mounted in a rotatable manner about a roller axis, and a roller cover, which encloses the cleaning roller in the circumferential direction, at least in part, and has at least one displaceable covering element for optionally closing and/or releasing an opening region of the roller cover. In order to create a wet-cleaning appliance which, as far as the user is concerned, can be transferred in a particularly convenient and reliable manner from mopping operation to regeneration operation, the displaceable covering element should be coupled to the cleaning roller by a gear mechanism, in particular a toothed gear mechanism, such that the cleaning roller can be displaced by virtue of the covering element being displaced or the covering element can be displaced by virtue of the cleaning roller being displaced.

11 Claims, 8 Drawing Sheets

(58) Field of Classification Search
CPC ..... A47L 11/4069; A47L 11/4038; A47L 11/4075; A47L 11/4041; A47L 11/4058; A47L 13/22; A47L 11/085; A47L 11/185; A47L 13/44; A47L 13/46; A47L 13/48; A47L 11/4063; A47L 13/254
See application file for complete search history.

(56) References Cited

U.S. PATENT DOCUMENTS

| | | | | |
|---|---|---|---|---|
| 4,875,246 | A | 10/1989 | MacGregor | |
| 5,657,504 | A | 8/1997 | Khoury | |
| 7,150,068 | B1 * | 12/2006 | Ragner | A47L 5/22 15/340.2 |
| 8,166,608 | B2 * | 5/2012 | Becker | A47L 5/34 15/372 |
| 9,289,105 | B2 | 3/2016 | Moes | |
| 2004/0154123 | A1 * | 8/2004 | Christopher | A47L 11/4058 15/320 |
| 2007/0011838 | A1 | 1/2007 | Davis et al. | |
| 2008/0086838 | A1 * | 4/2008 | Yoo | A47L 9/0488 15/415.1 |
| 2013/0086760 | A1 * | 4/2013 | Han | A47L 11/4058 15/49.1 |

FOREIGN PATENT DOCUMENTS

| | | | |
|---|---|---|---|
| DE | 10 2014 119 188 | A1 | 6/2016 |
| EP | 0 898 924 | A1 | 3/1999 |

OTHER PUBLICATIONS

International Search Report of PCT/EP2017/064748, dated Sep. 22, 2017.
International Search Report of PCT/EP2017/064357, dated Oct. 16, 2017.
International Search Report of PCT/EP2017/064365, dated Sep. 20, 2017.
International Search Report of PCT/EP2017/064745, dated Sep. 20, 2017.

* cited by examiner 24
23
1
20
10
22
21
2
3

WET-CLEANING APPLIANCE HAVING A CLEANING ROLLER

CROSS REFERENCE TO RELATED APPLICATIONS

This application is the National Stage of PCT/EP2017/064359 filed on Jun. 13, 2017, which claims priority under 35 U.S.C. § 119 of German Application No. 10 2016 111 811.7 filed on Jun. 28, 2016, the disclosures of which are incorporated by reference. The international application under PCT article 21(2) was not published in English.

FIELD OF TECHNOLOGY

The invention relates to a wet-cleaning appliance, in particular to a wet mop, having a cleaning roller mounted so that it can rotate around a roller axis, and a roller cover that at least partially encloses the cleaning roller in a circumferential direction, which has at least one displaceable covering element for optionally closing and/or releasing an opening region of the roller cover.

The invention further relates to a method for operating a wet-cleaning appliance, wherein a rotatable cleaning roller for a regeneration operation of the cleaning roller is displaced away from a surface to be cleaned and at least partially enclosed with a roller cover.

PRIOR ART

Wet-cleaning appliances or methods for operating a wet-cleaning appliance are known in prior art.

For example, DE 102 29 611 B3 discloses a wet-cleaning appliance with a mopping body that can be driven so as to turn around a rotational axis, in which a cleaning liquid is removed from a supply tank and sprayed onto the surface of the mopping body by means of spray nozzles arranged in the direction of the rotational axis of the mopping body. The mopping body moistened in this way is guided over a surface to be cleaned during a mopping operation, wherein the mopping body picks up dirt from the surface to be cleaned.

During the mopping operation, the mopping body increasingly accumulates dirt, thus necessitating a regeneration. To this end, the mopping body is lifted from the surface to be cleaned, enclosed in a housing and sprayed with unused cleaning liquid. The mopping body rotates, so that cleaning liquid and dirt are driven out of the mopping body, hit the interior side of the housing, and are transferred to a receiving tank.

The mopping body is lifted from the surface to be cleaned manually by a user of the wet-cleaning appliance. The housing is also manually guided around the mopping body. This is inconvenient, since the user of the wet-cleaning appliance must manually perform at least two movements. In the process, it can happen that the user forgets to enclose the mopping body in the housing, so that cleaning liquid can get into the environment during a regeneration operation of the mopping body.

SUMMARY OF THE INVENTION

Therefore, the object of the invention is to create a wet-cleaning appliance that is especially convenient for a user and can be reliably switched from a mopping operation to a regeneration operation.

In order to achieve the aforementioned object, it is proposed that the displaceable covering element be coupled with the cleaning roller by a gear mechanism, in particular a toothed gear mechanism, in such a way that the cleaning roller can be displaced by displacing the covering element, or the covering element can be displaced by displacing the cleaning roller.

According to the invention, the displacement of the covering element and displacement of the cleaning roller are coupled in such a way that displacing the covering element simultaneously causes a displacement of the cleaning roller, and that displacing the cleaning roller simultaneously causes a displacement of the covering element. As a consequence, there is no danger that a user will neglect to displace the covering element before a regeneration operation and that cleaning liquid will leak out, for example. In like manner, this prevents a bumping of the covering element against the cleaning roller during the displacement and/or a failure to remember to lift the cleaning roller from the surface. According to the invention, the covering element is thus automatically displaced during a displacement of the cleaning roller, and vice versa. Therefore, the user must only displace either the covering element or the cleaning roller, wherein a displacement of the cleaning roller or covering element then takes place automatically. The displacement of the covering element or cleaning roller is preferably triggered by activating a corresponding switch on the wet-cleaning appliance. However, the covering element or cleaning roller can alternatively also be manually displaced.

In order to couple the displacements, a mechanically operatively connected gear mechanism is arranged between the covering element and cleaning roller, which transfers a displacement movement of the covering element or cleaning roller to the cleaning roller or covering element. The gear mechanism can especially advantageously be a toothed gear mechanism with a plurality of toothed gear mechanism elements, such as toothed wheels and/or toothed racks. The gear mechanism can have a single stage or multistage design. In particular during the transfer of energy from the covering element to the cleaning roller or vice versa, a transmission that reduces the force to be applied for displacement is conceivable.

It is further proposed that the covering element be displaceable in a circumferential direction of the cleaning roller around a covering axis, in particular rotatable around the roller axis. The roller cover is designed in the circumferential direction of the cleaning roller, and here covers at least a partial circumferential region of the cleaning roller. In order to complete the roller cover, the covering element can advantageously be displaced, in particular rotated, around the covering axis, so that an opening region of the roller cover is closed or opened as displacement continues. It is here especially advantageous that the covering axis be the same as the roller axis. In this case, there exists a shared axis, around which both the cleaning roller and covering element rotate. This ensures that the rotational paths of the covering element and cleaning roller will not cross and result in a collision. At the same time, it can also be ensured that the covering element will likewise be spaced apart from the surface given a displacement of the cleaning roller from a surface to be cleaned, so that a collision between the covering element and surface can be avoided when the covering element is displaced into the opening region of the roller cover.

It is further proposed that the roller axis be arranged on a swiveling arm that is mounted on a housing of the wet-cleaning appliance and can pivot around a swivel axis. The displacement of the roller axis, i.e., the lifting of the cleaning roller, can basically take place by way of a linear movement or a swiveling movement, wherein the swiveling of the roller axis along a curved path is here preferably proposed. For this purpose, the wet-cleaning appliance has a swiveling arm mounted on a swivel axis on the housing of the wet-cleaning appliance. The swiveling arm carries the roller axis, which is preferably oriented parallel to the swiveling axis, and thus is displaced around the swivel axis of the swiveling arm while swiveling the swiveling arm along a circular path. Depending on the length of the swiveling arm and position of the roller axis on the swivel arm, a lever can be varied to determine the force required for displacing the roller axis.

It is proposed that the gear mechanism be arranged at least partially on the swiveling arm. The swiveling arm thus carries one of several gear mechanism elements of the gear mechanism, so that displacing the swiveling arm simultaneously leads to a driving of the gear mechanism elements, for example. As a result, displacing the swiveling arm makes it possible to simultaneously trigger the displacement of the cleaning roller and displacement of the covering element.

In this connection, it is proposed in particular that the covering element have a first gear mechanism element, and that the housing of the wet-cleaning appliance have a second gear mechanism element. One of the gear mechanism elements is here preferably movably arranged, and the other gear mechanism element is immovably arranged. For example, the housing of the wet-cleaning appliance can have a toothed system resembling a toothed rack, and the covering element can have a corresponding partial region, which is designed like a rotatable toothed wheel, and leads to a rotation of the covering element during a displacement along the toothed rack. This rotation makes it possible to close or open the opening region of the roller cover. At least the housing of the wet-cleaning appliance preferably always has a gear mechanism element that is immovable relative to the housing, which serves as a counter-bearing for the remaining gear mechanism elements. In addition, it is also possible that one of the movable gear mechanism elements be drivable by means of a drive.

One variant proposes that the first gear mechanism element engage into the second gear mechanism element, wherein the swiveling arm has a covering axis, in particular the roller axis, on which the covering element is rotatably mounted. This variant describes a single stage construction of the gear mechanism, in which the torque is transmitted directly from the first gear mechanism element to the second gear mechanism element, or vice versa, without interspersing additional gear mechanism elements. The swiveling arm has formed on it an axis that is preferably oriented parallel to the swiveling axis of the swiveling arm, and simultaneously represents the covering axis and roller axis. Swiveling the swiveling arm causes a displacement of the covering axis and covering element, wherein the covering element that carries the first gear mechanism element interacts with the second gear mechanism element fixedly formed on the housing of the wet-cleaning appliance. The covering element is here displaced into the opening region of the roller cover. Since the covering axis is preferably simultaneously the roller axis, a displacement of the roller axis also takes place, and the cleaning roller is thus lifted from the surface to be cleaned.

An alternative variant proposes that a third gear mechanism element, in particular a toothed wheel, be arranged on the swiveling arm, which engages into the second gear mechanism element, and that the gear mechanism further has a fourth gear mechanism element, in particular a toothed wheel, which is connected with the third gear mechanism element in a force-transmitting manner, and engages into the first gear mechanism element. This variant utilizes a multi-stage gear mechanism with a total of four gear mechanism elements. For example, two of the gear mechanism elements, specifically here the third gear mechanism element and fourth gear mechanism element, can be designed as toothed wheels, and the first and second gear mechanism elements can be designed as toothed racks that are immovable relative to the covering element or housing (e.g., as partial regions of the covering element/housing). Since the first and second gear mechanism elements thus do not engage directly into each other, an upward and downward transmission from the first to the second gear mechanism element or vice versa can be achieved during force transmission by selecting the remaining gear mechanism elements. By swiveling the swiveling arm, for example by means of a drive, the third gear mechanism element can thus be made to rotate relative to the second gear mechanism element, which simultaneously causes the fourth gear mechanism element to rotate, which in turn displaces the covering element relative to the roller cover.

It is proposed that a drive be allocated to the swiveling axis of the swiveling arm or one of the gear mechanism elements. The drive is preferably an electric motor, but can also be a drive that is manually activated by a user of the wet-cleaning appliance or the like. Also possible are solenoids, compressed air-dependent air bellows or the like. As a consequence, at least one of the movable gear mechanism elements or the swiveling arm can be driven, wherein the movement is transferred to the additional gear mechanism elements via the gear mechanism.

It is further proposed that the housing have a first slotted guide, into which an engaging element arranged on the covering element engages. As a result, the displacement of the covering element relative to the housing of the wet-cleaning appliance can be guided in such a way that the covering element does not touch the surface to be cleaned during a displacement of the covering element into the opening region of the roller cover. This configuration is beneficial in particular if an actively driven gear mechanism element is directly allocated to the covering element. The drive causes the covering element to rotate, wherein the shape and position of the slotted guide on the housing prescribes the displacement of the covering element relative to the housing. As a consequence, the slotted guide can prescribe a displacement path of the covering element that does not lead to contact between the covering element and a surface to be cleaned, for example. The slotted guide is preferably designed in such a way that the covering element is held so far inside of the housing during the entire displacement movement that it cannot be swiveled out over the circumference of the housing and/or over potentially present spacer elements.

It is further proposed that the covering element have a second slotted guide, into which an engaging element arranged on the housing engages. In conjunction with the first slotted guide of the housing mentioned above, a dual slot controller can thus be designed for the displacements of the covering element and cleaning roller. This overcomes so-called dead points within the slotted guide, on which the inner forces to be applied for a displacement go to infinity and can lead to a halting of the displacement movement. The arrangement of the second slotted guide circumvents the dead points by displacing the guiding forces to the second slotted guide. Given a displacement of the covering element from a closed position into an opening position, i.e., out of the opening region of the roller cover, the displacement movement is initially guided by a first slotted guide formed in the housing, wherein once a dead point has been reached, the guiding task is assumed by the second slotted guide formed on the covering element.

It is further proposed that the roller cover have at least one air passage opening, advantageously one respective air passage opening on end regions lying opposite each other in the longitudinal extension of the roller cover, and especially preferably in combination with another air passage opening in a central region of the roller cover. As a result of such an arrangement, an air flow that gets into the roller cover at the end regions through the air passage openings is guided along the longitudinal extension of the cleaning roller to the central air passage opening, where the air can finally exit the roller cover again.

Finally proposed as well apart from the wet-cleaning appliance described above is a method for operating a wet-cleaning appliance, in particular a wet-cleaning appliance of the kind described above, wherein a rotatable cleaning roller for a regeneration operation of the cleaning roller is displaced away from a surface to be cleaned, and at least partially enclosed with a roller cover, wherein the cleaning roller is displaced by a displacement of a covering element of the roller cover, or the covering element is displaced by a displacement of the cleaning roller, in particular by means of a gear mechanism that provides an operative connection between the covering element and cleaning roller. This provides a method which enables an in particular simultaneous displacement of the cleaning roller and covering element for a regeneration operation of the cleaning roller, without the user of the wet-cleaning appliance having to perform several manual movements for this purpose. In particular, it is only necessary to displace either the cleaning roller or the covering element, wherein a displacement of the other element, specifically the covering element or cleaning roller, then inevitably follows. The covering element or cleaning roller can here be displaced either manually by the user, or by means of a drive that the user activates, for example via a switch.

Within the meaning of the invention, wet-cleaning appliances are basically to be understood as those appliances that can perform a wet cleaning, whether exclusively or among other operations. These include on the one hand the hand-guided and automatically movable wet-cleaning appliances, in particular cleaning robots as well, and on the other combined drying and wet-cleaning appliances, which can perform both a wet cleaning and dry cleaning operation. Also intended within the meaning of the invention in addition to conventional floor cleaning appliances for cleaning a floor are wet-cleaning appliances for cleaning above-floor surfaces. For example, these also include appliances for cleaning windows and the like.

BRIEF DESCRIPTION OF THE DRAWINGS

The invention will be described in greater detail below based on exemplary embodiments. Shown on.

DESCRIPTION OF EMBODIMENTS

Figure 1:
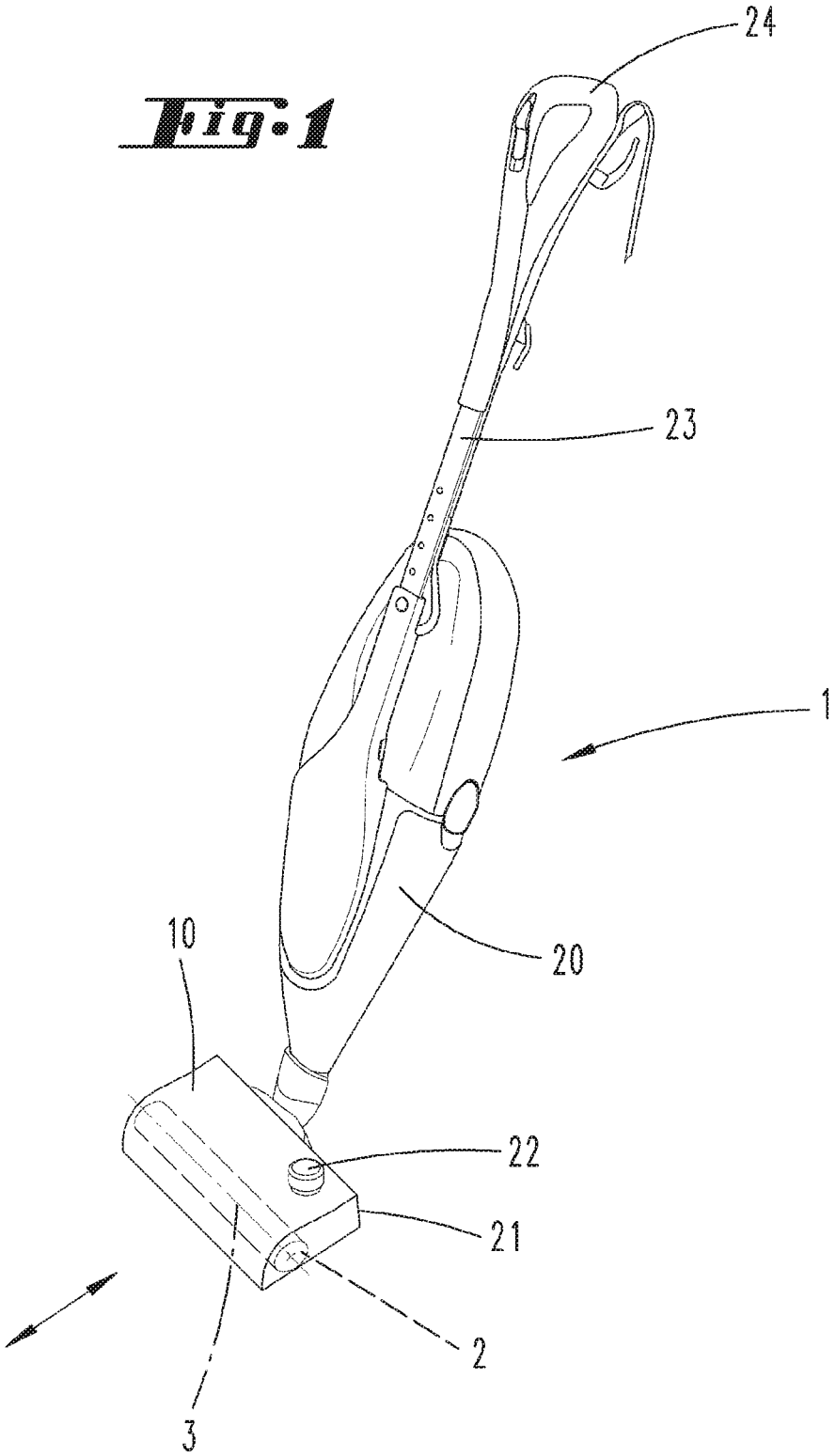
FIG. 1 is a wet-cleaning appliance according to the invention.

FIG. 1 shows a wet-cleaning appliance 1, which is here designed as a wet-mopping appliance with a base device 20 and an attachment 21. A handle 23 with a handgrip 21 is arranged on the base device 20, and can be utilized by a user to guide the wet-cleaning appliance 1 over a surface to be cleaned. The handle 23 is here advantageously telescoping in design, so that a user can adjust the height of the wet-cleaning appliance 1 to his or her physical size. During a conventional mopping operation, the user displaces the wet-cleaning appliance 1 in a forward and backward movement over the surface to be cleaned, during which he or she alternately pushes the wet-cleaning appliance 1 away from and pulls it toward him or herself.

The attachment 21 has a housing 10 in which a tank (not shown) for cleaning liquid is arranged. A filling spout 22 can be used to fill cleaning liquid into the tank. The housing further incorporates a cleaning roller 2, which can be rotated around a roller axis 3. The roller axis 3 is essentially perpendicular to a conventional direction of movement of the wet-cleaning appliance 1. The cleaning fluid can be dispensed from the tank onto the surface of the cleaning roller 2 so as to moisten it.

During a mopping operation, the cleaning roller 2 rotates around the roller axis 3, so that the circumferential surface of the cleaning roller 2 continuously rolls on the surface to be cleaned. A cleaning cover is usually wound around the cleaning roller 2, possibly with a sponge body that stores additional liquid interspersed. The cleaning cover is here a textile cleaning cloth, for example. During the cleaning operation, dirt continuously accumulates on the cleaning roller 2, i.e., the cleaning cover. For this reason, it may be necessary to regenerate the cleaning roller 2 after a certain period of operation, wherein dirt and liquid loaded with dirt are removed from the cleaning roller 2 during a regeneration operation. To this end, the cleaning roller 2 is usually rotated at a speed higher than the speed of the cleaning roller 2 during a mopping operation. As a result, dirt and liquid loaded with dirt is spun away from the cleaning roller 2. The sprayed off liquid can be collected and fed to a collecting tank.

Figure 2:
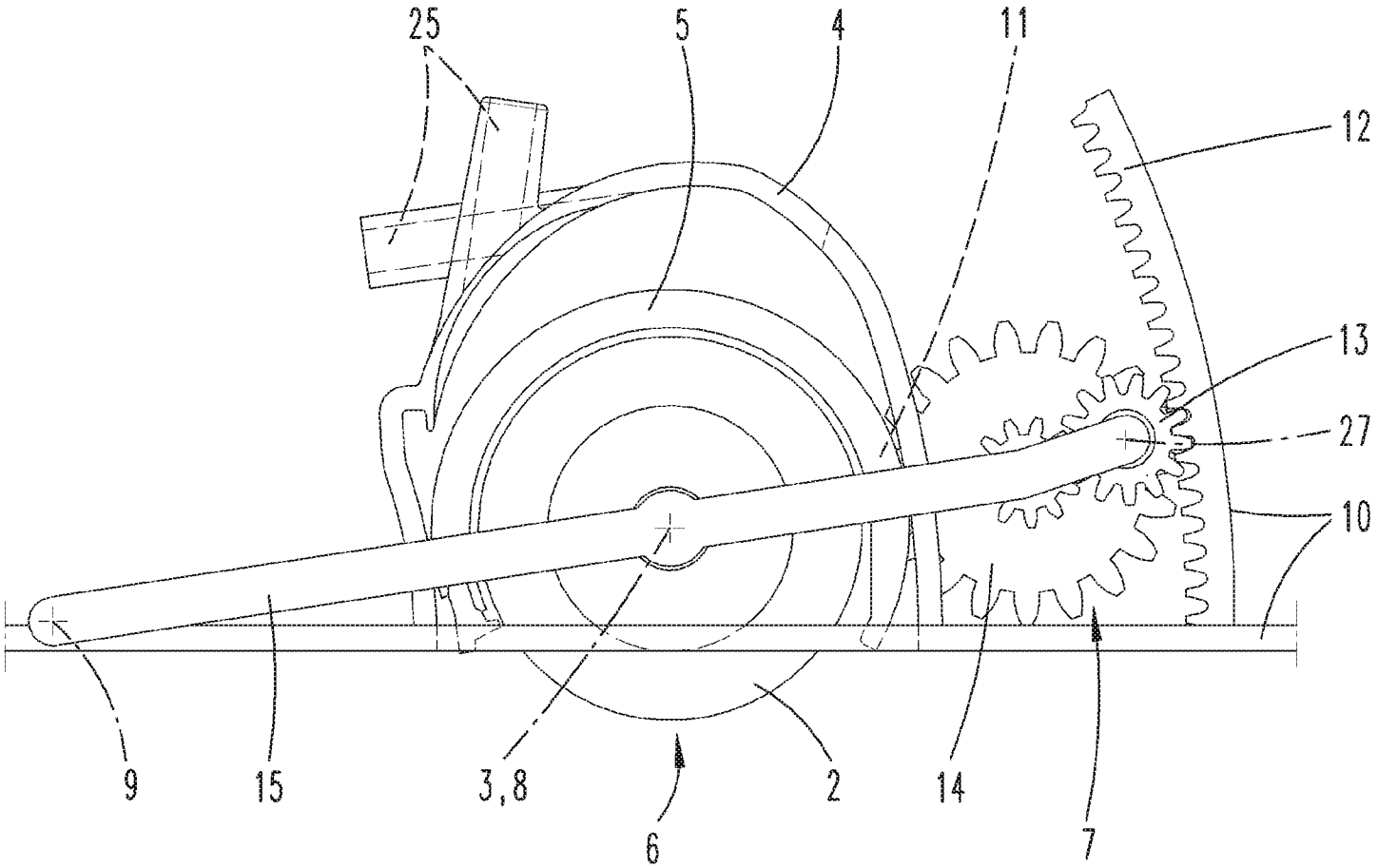
FIG. 2 is a partial region of a wet-cleaning appliance with a cleaning roller and a covering element during a mopping operation.

FIG. 2 shows a partial region of the housing 10 of the attachment 21, in which the cleaning roller 2 is held so that it can rotate around the roller axis 2. The roller axis 3 is arranged on a swiveling arm 15 situated on the housing 10, wherein the roller axis 3 extends essentially perpendicular to the longitudinal extension of the swiveling arm 15 and parallel to a swivel axis 9 of the swiveling arm 15. The swiveling arm 15 is held on the housing 10 of the attachment 21 so that it can pivot around the swivel axis 9.

The roller axis 3 simultaneously forms a covering axis 8 for a covering element 5 of a roller cover 4, which at least partially encloses the cleaning roller 2. The covering element 5 can be displaced relative to the roller cover 4 into an opening region 6 of the roller cover 4, so as to preferably completely close the roller cover 4 in a circumferential direction of the cleaning roller 2. The roller over 4 can be a partial region configured integrally with the housing 10. The roller cover 4 has air passage openings 25, of which one is arranged at each of the opposing end regions in a longitudinal extension of the roller cover 4, as well as one in a central length region of the roller cover 4. The air passage openings 25 allow ambient air to enter and exit the roller cover 4.

The end region of the swiveling arm 15 lying opposite the swivel axis 9 has allocated to it a gear mechanism 7, which has a total of four gear mechanism elements 11, 12, 13, 14. Initially arranged at the end region of the swiveling arm 15 is a gear mechanism element 13, which engages into a corresponding gear mechanism element 12 formed on the housing. Another gear mechanism element 14 is arranged on the circumferential side of the gear mechanism element 13 lying opposite the gear mechanism element 12, and is toothed with the gear mechanism element 13 on the one hand, and with a gear mechanism element 11 formed on the covering element 5 on the other. Just as the gear mechanism element 12, the gear mechanism element 11 forms a kind of toothed rack. The gear mechanism elements 13 and 14 are obviously designed as toothed wheels. The gear mechanism elements 11, 12, 13, 14 each operatively connected one with the other have toothed systems that correspond to each other.

Figure 3:
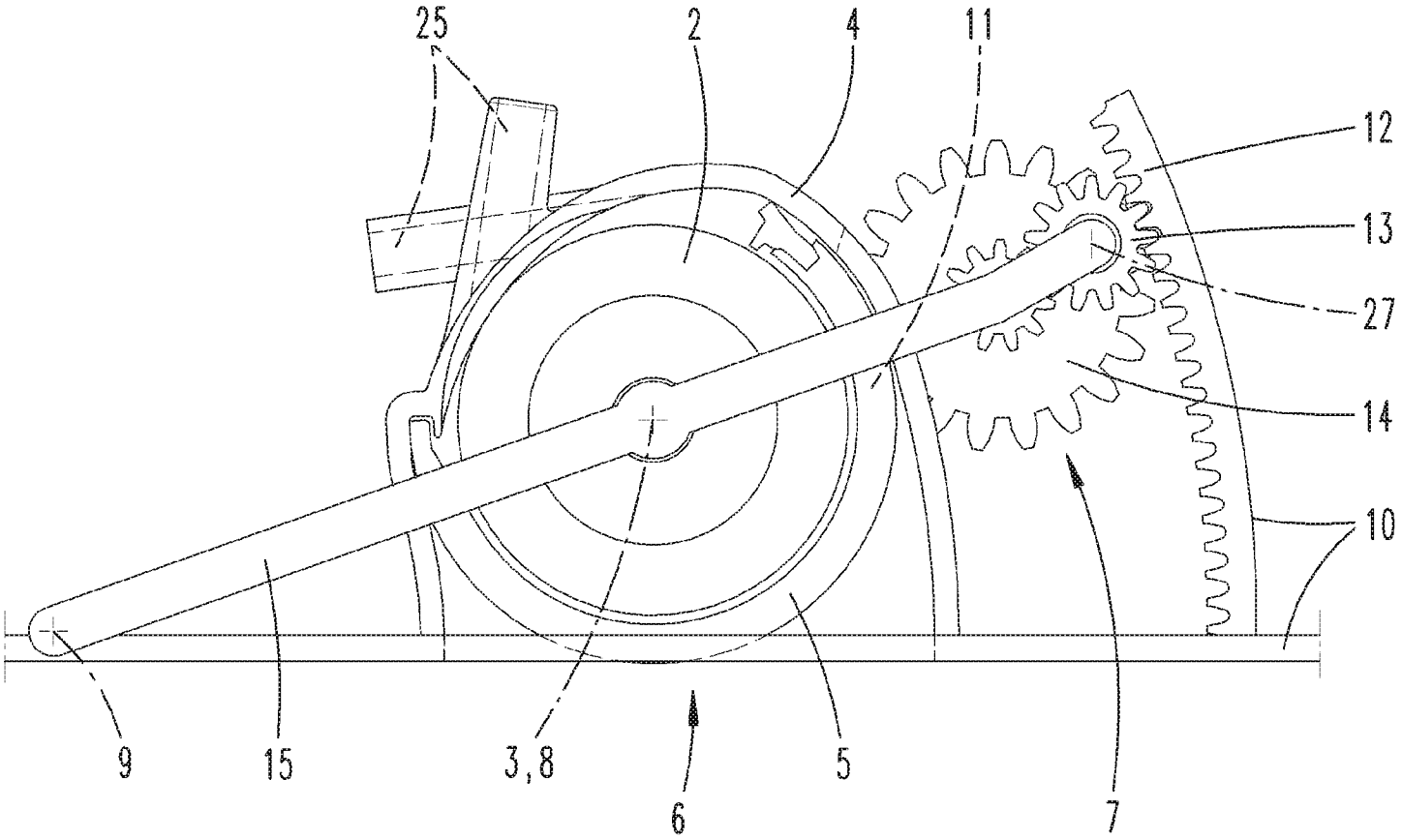
FIG. 3 is the partial region of the wet-cleaning appliance according to FIG. 2 with the cleaning element and covering element during a regeneration operation.

In order to get from the position of the cleaning roller 2 and covering element 5 shown on FIG. 2 to the position shown on FIG. 3, which corresponds to a regeneration operation of the cleaning roller 2, the swiveling arm 15 is swiveled around the swivel axis 9, specifically in a direction into the housing 10, i.e., away from the surface to be cleaned in relation to a conventional position of the wet-cleaning appliance 1 on the surface to be cleaned. The swiveling motion of the swiveling arm 15 can be initiated either manually by a user of the wet-cleaning appliance 1, for example via key activation, or automatically by a controller of the wet-cleaning appliance 1, which automatically initiates a regeneration operation once sensors have detected that the cleaning roller 3 is occupied with a defined level of dirt. An electric motor is preferably allocated to the swiveling arm 15. In addition, swiveling can also be initiated through a manual intervention by the user, for example also by gripping and swiveling the swiveling arm 15.

The swiveling motion of the swiveling arm 15 into the housing 10 of the wet-cleaning appliance 1 causes the gear mechanism element 13 to turn clockwise, and in the process to continuously engage into the toothed system of the gear mechanism element 12. On the side of the gear mechanism element 13 lying opposite the gear mechanism element 12 in the circumferential direction, a gear mechanism element 14 engages into the toothed system of the gear mechanism element 13. This gear mechanism element 14 is made to turn counterclockwise with the gear mechanism element 13 by the toothed system, and in so doing pushes the covering element 5 into whose gear mechanism element 11 it engages in the direction of the opening region 6 of the roller cover 4. As a consequence, the swiveling of the swiveling arm 15 simultaneously causes the cleaning roller 2 to lift from the surface to be cleaned, and the covering element 5 to displace into the opening region 6 of the roller cover 4.

As an alternative to the previously described drive of the swiveling arm 15 in the area of the swiveling axis 9, one of the gear mechanism elements 11, 12, 13, 14 can alternatively also be driven by an electric motor, e.g., the gear mechanism element 13, which is arranged on the end region of the swiveling arm 15 lying opposite the swiveling axis 9, and engages into the gear mechanism element 12 of the housing 10.

Figure 4:
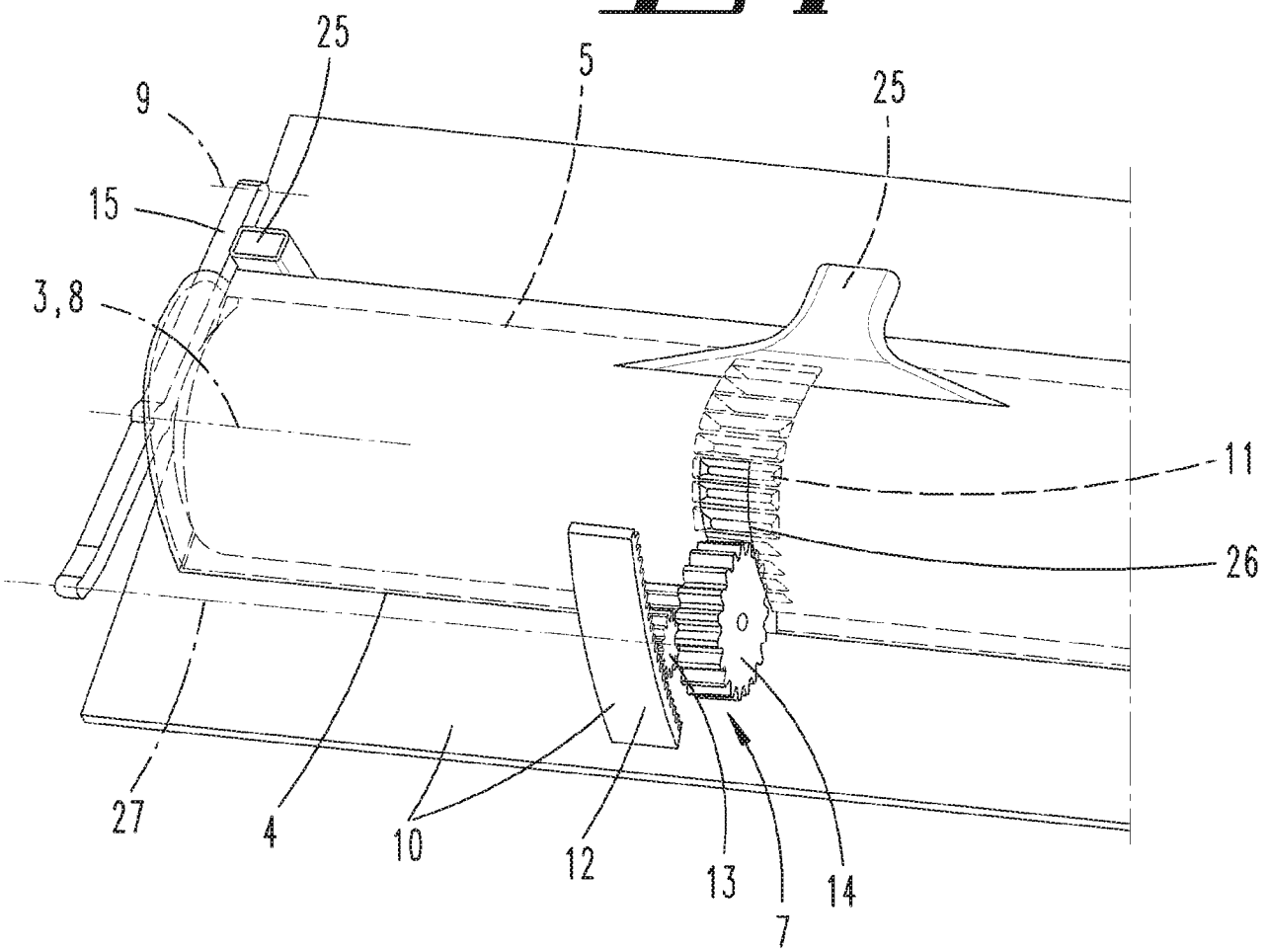
FIG. 4 is the partial region of the wet-cleaning appliance in a perspective view from outside.

FIG. 4 presents a perspective view from outside of the partial area of the wet-cleaning appliance 1 depicted on FIGS. 2 and 3. Visible is a portion of the housing 10 of the wet-cleaning appliance 1 that carries the roller cover 4. The cleaning roller 2 is arranged inside of the roller cover 4, and advantageously formed over the entire longitudinal extension of the roller cover 4. The swiveling arm 15 is arranged at an end region of the cleaning roller 2, and carries the roller axis 3. The end region of the swiveling arm 15 lying opposite the swiveling axis 9 is connected with the gear mechanism element 13, e.g., via a rotational axis 27 allocated to the end region. The gear mechanism element 13 engages into the gear mechanism element 12 of the housing 10, wherein a part of the housing 10 that carries the gear mechanism element 12 is here sketched in just as a section to gain a better view. It goes without saying that the housing 10 preferably envelops the roller cover 4 completely. The gear mechanism element 14 engaging into the gear mechanism element 13 engages through the roller cover 4 and into the toothed system of the gear mechanism element 11 of the covering element 5. To this end, the roller cover 4 has corresponding recesses 26.

Figure 5:
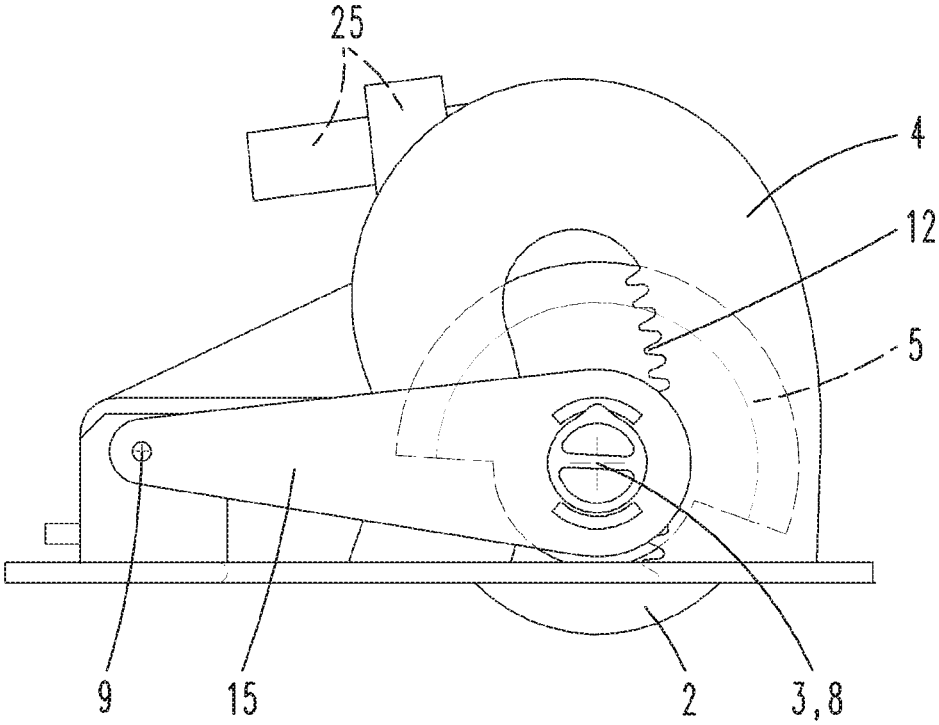
FIG. 5 is a partial region of a wet-cleaning appliance with a cleaning roller and covering element according to the second variant.
Figure 6:
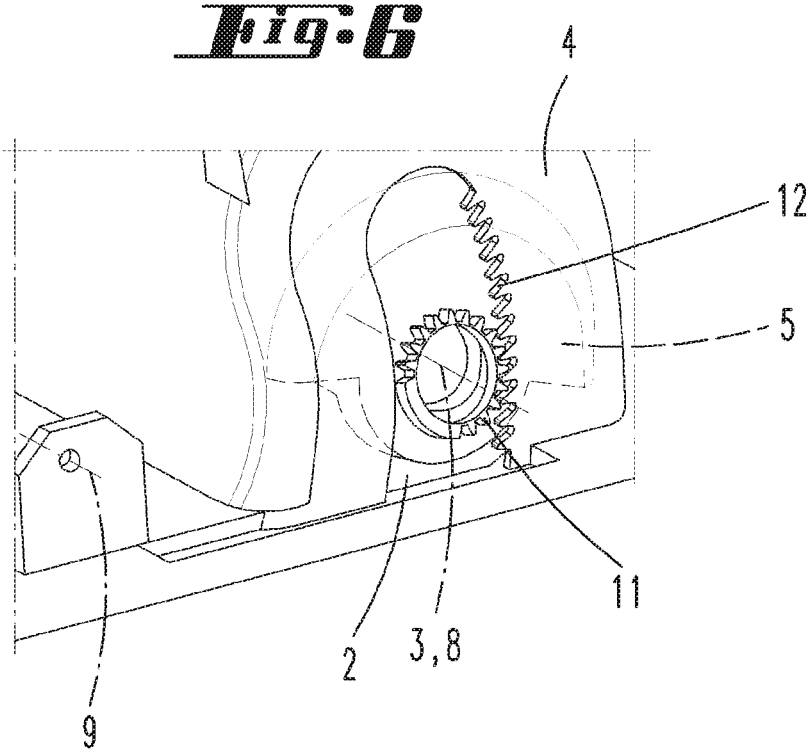
FIG. 6 is another view of the partial region of the wet-cleaning appliance according to FIG. 5.

FIGS. 5 and 6 show a second variant of the invention, in which the gear mechanism 7 is designed as a one-stage gear mechanism. The gear mechanism 7 comprises a first gear mechanism element 11, which is formed on the covering element 5, and a second gear mechanism element 12, which is formed on the housing 10 of the wet-cleaning appliance 1. Specifically, the depicted partial area of the wet-cleaning appliance 1 also has a swiveling arm 15 once again according to this variant, which can be swiveled around a swiveling axis 9. The end area of the swiveling arm 15 lying opposite the swiveling axis 9 carries the roller axis 3, which simultaneously is also the covering axis 8 for the covering element 5. The roller axis 3 or covering axis 8 engages through the roller cover 4 and into the cleaning roller 2. The covering element 5 has a first gear mechanism element 11, which engages into a corresponding second gear mechanism element 12 of the roller cover 4. If the swiveling arm 15 is now driven, for example via the swiveling axis 9, the swiveling arm 15 swivels further into the housing 10 of the wet-cleaning appliance 1, as a result of which the cleaning roller 2 arranged on the roller axis 3 is driven into the housing 10. The swiveling motion of the roller axis 3 or covering axis 8 thereby completed causes the covering element 5 to rotate along the shared toothed system of the gearing mechanism elements 11 and 12 in the clockwise direction into the opening region 6 of the roller cover 4. The swiveling motion of the swiveling arm 15 thus simultaneously lifts the cleaning roller 2 from the surface to be cleaned, i.e., swivels it further into the housing 10 of the wet-cleaning appliance 1, and moves the covering element 5 into the opening region 6 of the roller cover 4, so that the cleaning roller 2 is preferably completely enveloped in the circumferential direction by the roller cover 4 and covering element 5.

Figure 7:
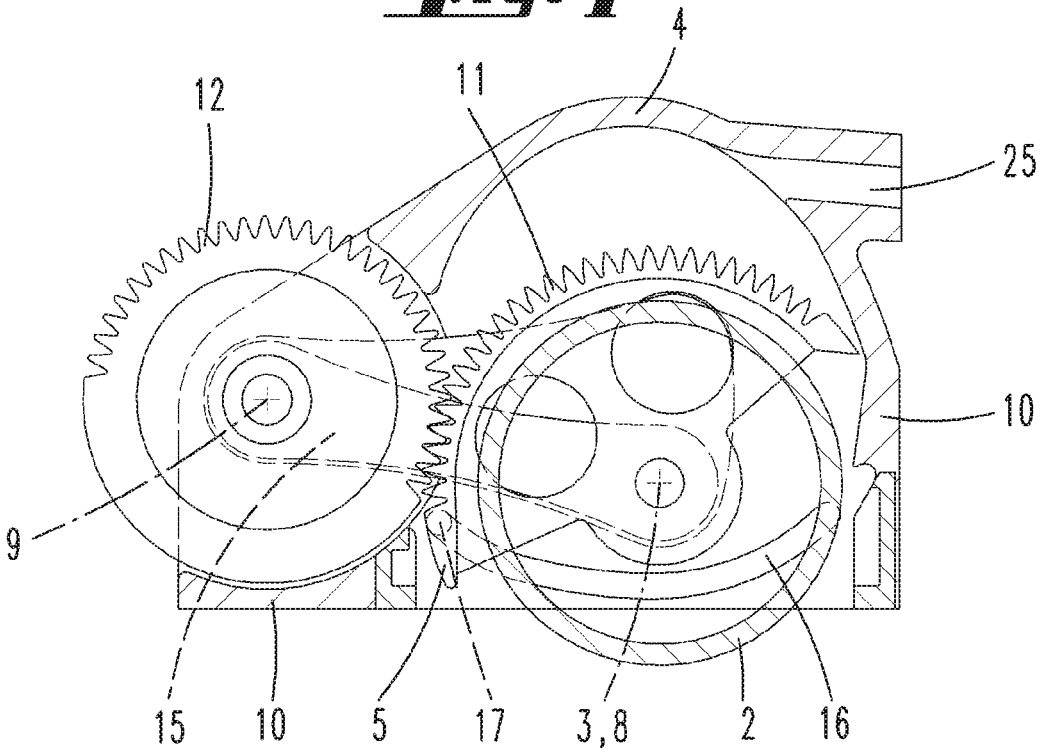
FIG. 7 is a partial region of a wet-cleaning appliance with a cleaning roller, a covering element and a slotted guide in a first position.
Figure 8:
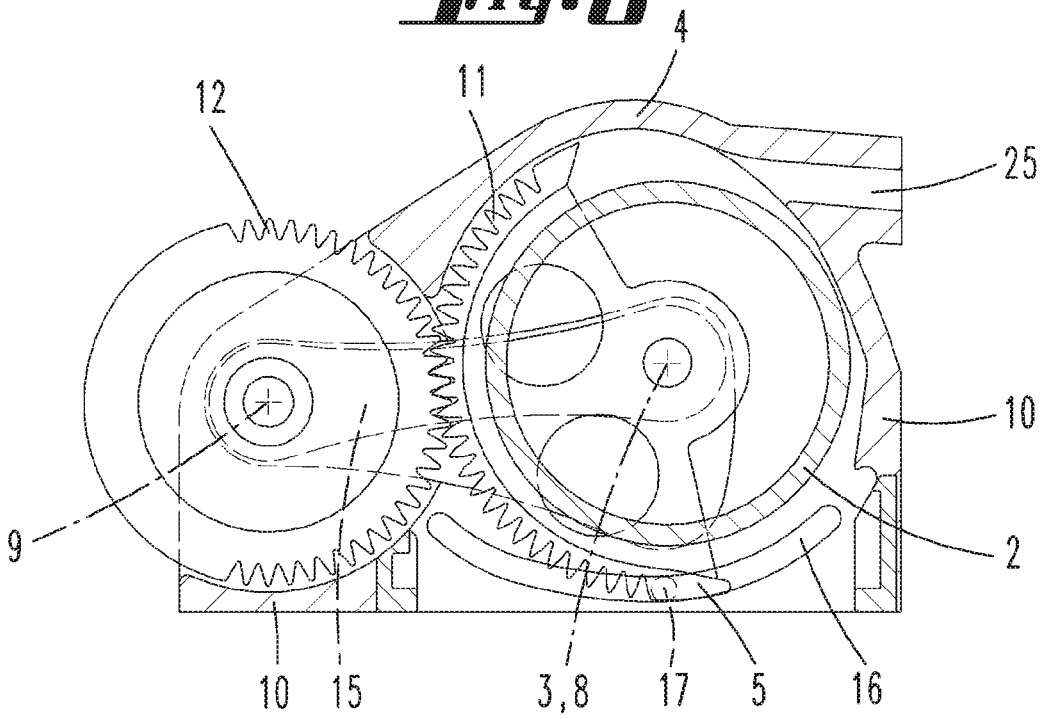
FIG. 8 is the partial region according to FIG. 7 in a second position.
Figure 9:
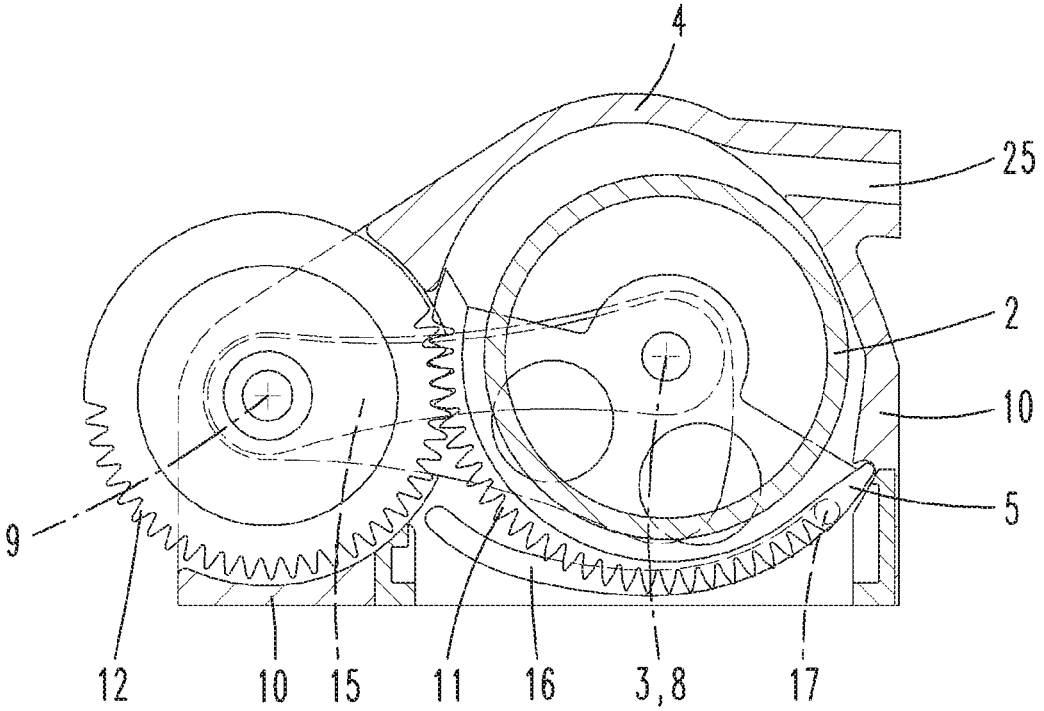
FIG. 9 is the partial region according to FIG. 7 in a third position.

FIGS. 7 to 9 show a third embodiment variant of a partial area of the wet-cleaning appliance 1. In this embodiment variant, a driven gear mechanism element 12 is allocated to the covering element 5. The gear mechanism element 12 rotates around the swiveling axis 9 of the swiveling arm 15. The toothed system of the gear mechanism element 12 engages into a toothed system of the covering element 5, which forms a first gear mechanism element 11. The covering element 5 further has an engaging element 17 in the form of a sliding block, which engages into a slotted guide 16 of the housing 10. Both the covering element 5 and the cleaning roller 2 are again rotatably mounted via a shared roller axis or covering axis 8, wherein the axes 3, 8 are arranged on the end area of the swiveling arm 15 lying opposite the swiveling axis 9. In this embodiment variant, a clockwise rotation of the gear mechanism element 12 around the swiveling axis 9 takes place proceeding from the position of a mopping operation depicted on FIG. 7. As a result, the covering element 5 toothed with the gear mechanism element 12 via the gear mechanism element 11 is rotated counterclockwise around the covering axis 8, i.e., in the direction of the opening region 6 of the roller cover 4. Since the engaging element 17 of the covering element 5 engages into the slotted guide 16 of the housing 10, the path of the engaging element 17, and hence also of the covering element 5, is prescribed relative to the housing 10. As a consequence, the covering axis 8, which simultaneously is the roller axis 3, is further displaced into the housing 10, which simultaneously causes the cleaning roller 2 to drive into the housing 10. The cleaning roller 2 is thus lifted from the surface to be cleaned and swiveled into the housing 10 of the wet-cleaning appliance 1, which takes place at the same time that the covering element 5 closes the opening region 6. Additional FIGS. 8 and 9 show the continuing rotation of the covering element 5 along with the driving of the cleaning roller 2 into the housing 10. The position according to FIG. 9 corresponds to the position of the covering element 5 and cleaning roller 2 during a regeneration operation of the wet-cleaning appliance 1.

Figure 10:
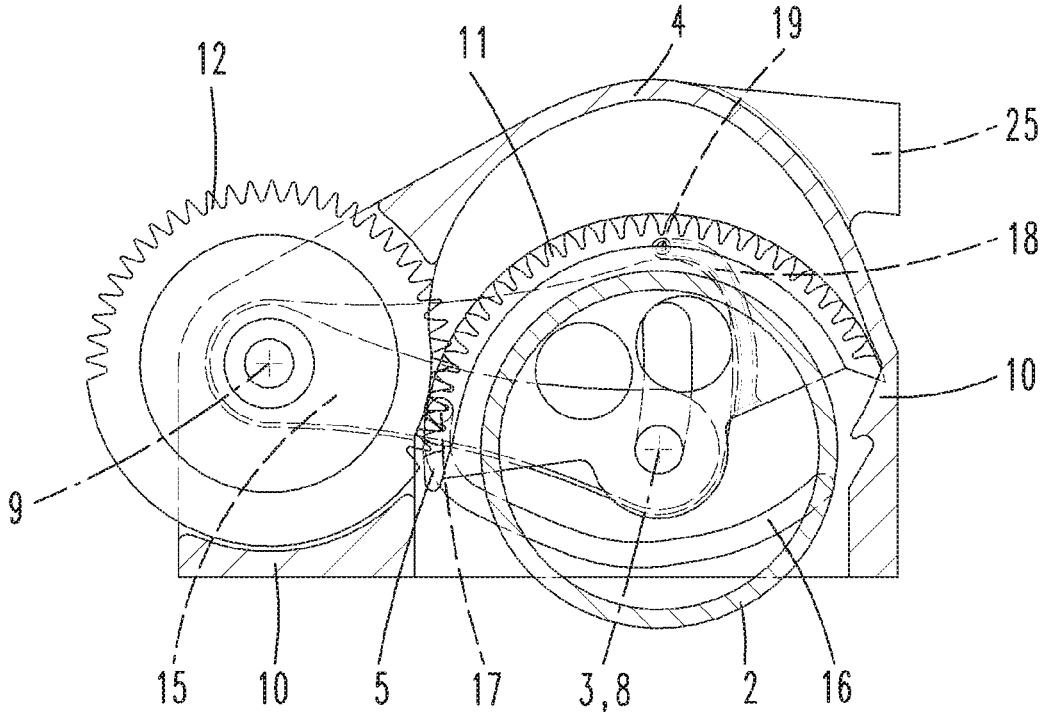
FIG. 10 is a partial region of a wet-cleaning appliance with two slotted guides in a first position.
Figure 11:
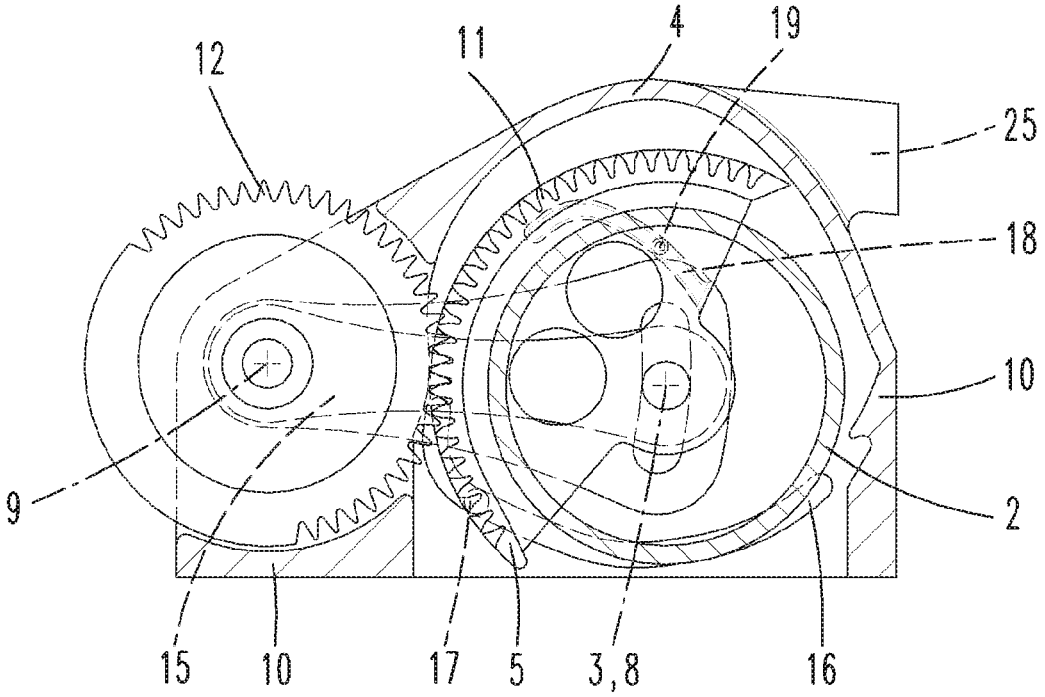
FIG. 11 is the partial region according to FIG. 10 in a second position.
Figure 12:
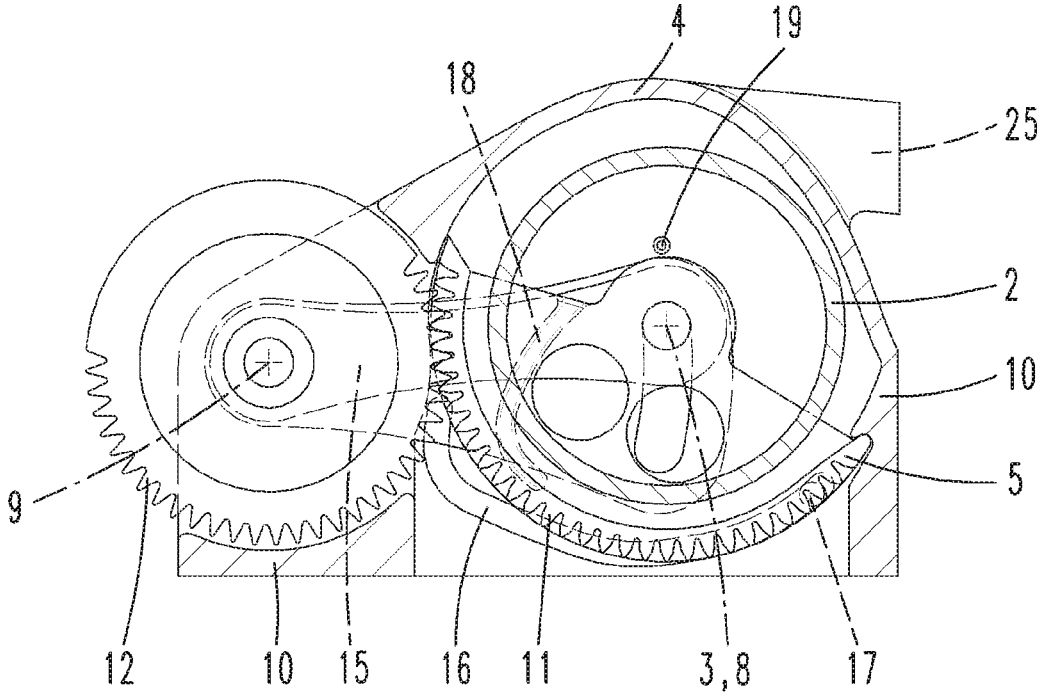
FIG. 12 is the partial region according to FIG. 10 in a third position.

FIGS. 10 to 12 show a fourth embodiment variant of the invention, in which the displacement movements of the cleaning roller 2 and covering element 5 are prescribed by two slotted guides 16, 18. Apart from the first slotted guide 16 of the housing 10 already described with reference to FIGS. 7 to 9, the covering element 5 now has a second slotted guide 18, into which an engaging element 19 of the housing 10 engages. While the covering element 5 rotates, the relatively large turning radius can give rise to dead points inside of the slide control system, at which the internal forces approach infinity. Introducing the second slotted guide 18 makes it possible to circumvent these dead points by displacing the guiding forces onto the second slotted guide 18. As shown on FIGS. 10 to 12, the rotation of the covering element 5 is initially guided by the second slotted guide 18 and the engaging element 19, proceeding from the position corresponding to a mopping operation according to FIG. 10. As rotation continues (transition from FIG. 11 to FIG. 12), the engaging element 19 is released from the slotted guide 18, so that the rotation of the covering element 5 is guided by the first slotted guide 16. Given a correspondingly reversed rotational direction of the covering element 5, i.e., from a position corresponding to a regeneration operation (FIG. 12) into a position corresponding to a mopping operation (FIG. 10), the lifting of the covering element 5 is initially guided by the first slotted guide 16 until a dead point has been reached. Starting at that point, the engaging element 19 of the housing 10 engages into the slotted guide 18 of the covering element 5, and takes over guidance of the other rotational motion.

A regeneration operation of the wet-cleaning appliance 1 is now introduced in such a way that the cleaning roller 2 and covering element 5 are displaced according to one of the previously described embodiment variants, until the cleaning roller 2 has been completely encased by the roller cover 4 and covering element in the circumferential direction. The cleaning roller 2 is then greatly accelerated, if necessary preceded or accompanied by the addition of liquid. The high speed of the cleaning roller 2, which should be higher than during a mopping operation, spins the liquid along with the dirt out of the cleaning roller 2. A stripping device can additionally be provided, which contacts the surface of the cleaning roller 2 and also supports regeneration. The rotation of the cleaning roller 2 simultaneously induces a flow of ambient air, so that air streams into the roller cover 4 through the air passage openings 25 arranged at the end side on the roller cover 4, propagates along the longitudinal extension of the cleaning roller 2 until up to another air passage opening 25 arranged in a central area of the longitudinal extension of the roller cover 4. The accelerated air supports the transport of liquid and dirt in the direction of a collecting channel that has the air passage opening 25. As a whole, this yields an optimal regeneration result.

Even though the invention was explained by example in relation to a hand-guided wet-cleaning appliance 1, the wet-cleaning appliance 1 according to the invention can of course also be a cleaning robot. Furthermore, the wet-cleaning appliance 1 can be a combined mopping and vacuuming appliance or a wet-cleaning appliance 1 that can perform exclusively a wet-cleaning task.

REFERENCE LIST

1 Wet-cleaning appliance
2 Cleaning roller
3 Roller axis
4 Roller cover
5 Covering element
6 Opening region
7 Gear mechanism
8 Covering axis
9 Swiveling axis
10 Housing
11 Gear mechanism element
12 Gear mechanism element
13 Gear mechanism element
14 Gear mechanism element
15 Swiveling arm
16 Slotted guide
17 Engaging element
18 Slotted guide
19 Engaging element
20 Base device
21 Attachment
22 Filling spout
23 Handle
24 Handgrip
25 Air passage opening
26 Recess
27 Rotational axis

The invention claimed is:

1. A wet-cleaning appliance (1), in particular a wet mop, having a cleaning roller (2) mounted so that it can rotate around a roller axis (3), and a roller cover (4) that at least partially encloses the cleaning roller (2) in a circumferential direction, which has at least one displaceable covering element (5) for optionally closing and/or releasing an opening region (6) of the roller cover (4), wherein the displaceable covering element (5) is coupled with the cleaning roller (2) by a gear mechanism (7), in particular a toothed gear mechanism, in such a way that the cleaning roller (2) can be displaced by displacing the covering element (5), or the covering element (5) can be displaced by displacing the cleaning roller (2), wherein the covering element (5) is displaceable in a circumferential direction of the cleaning roller (2) around a covering axis (8), and wherein the covering element is displaceable in a direction coaxial to the circumferential surface of the cleaning roller.

2. The wet-cleaning appliance (1) according to claim 1, wherein the covering element (5) is rotatable around the roller axis (3).

3. The wet-cleaning appliance (1) according to claim 1, wherein the roller axis (3) is arranged on a swiveling arm (15) that is mounted on a housing (10) of the wet-cleaning appliance (1) and can pivot around a swivel axis (9).

4. The wet-cleaning appliance (1) according to claim 3, wherein the gear mechanism (7) is arranged at least partially on the swiveling arm (15).

5. The wet-cleaning appliance (1) according to claim 3, wherein the covering element (5) has a first gear mechanism element (11), and the housing (10) of the wet-cleaning appliance (1) has a second gear mechanism element (12).

6. The wet-cleaning appliance (1) according to claim 5, wherein the first gear mechanism element (11) engages into the second gear mechanism element (12), wherein the swiveling arm (15) has a covering axis (8), in particular the roller axis (3), on which the covering element (5) is rotatably mounted.

7. The wet-cleaning appliance (1) according to claim 5, wherein a third gear mechanism element (13), in particular a toothed wheel, is arranged on the swiveling arm (15), which engages into the second gear mechanism element (12), and wherein the gear mechanism (7) further has a fourth gear mechanism element (14), in particular a toothed wheel, which is connected with the third gear mechanism element (13) in a force-transmitting manner, and engages into the first gear mechanism element (11).

8. The wet-cleaning appliance (1) according to claim 3, wherein a drive, in particular an electric motor, is allocated to the swiveling axis (9) of the swiveling arm (15) or one of the gear mechanism elements (11, 12, 13, 14).

9. The wet-cleaning appliance (1) according to claim 3, wherein the housing (10) has a first slotted guide (16), into which an engaging element (17) arranged on the covering element (5) engages.

10. The wet-cleaning appliance (1) according to claim 9, wherein the covering element (5) has a second slotted guide (18), into which an engaging element (19) arranged on the housing (10) engages.

11. A method for operating the wet-cleaning appliance (1) a having a cleaning roller (2) mounted so that it can rotate around a roller axis (3), and a roller cover (4) that at least partially encloses the cleaning roller (2) in a circumferential direction, which has at least one displaceable covering element (5) for optionally closing and/or releasing an opening region (6) of the roller cover (4), wherein the displaceable covering element (5) is coupled with the cleaning roller (2) by a gear mechanism (7), in particular a toothed gear mechanism, the method comprising:

displacing the rotatable cleaning roller (2) for a regeneration operation of the cleaning roller (2) away from a surface to be cleaned, wherein the cleaning roller (2) is displaced by a displacement of the covering element (5) of the roller cover (4), or the covering element (5) is displaced by a displacement of the cleaning roller (4), by means of the gear mechanism (7) that provides an operative connection between the covering element (5) and cleaning roller (2), wherein the covering element (5) is displaced in a circumferential direction of the cleaning roller (2) around a covering axis (8) and wherein the covering element is displaceable in a direction coaxial to the circumferential surface of the cleaning roller.

* * * * *